US011246410B2

(12) United States Patent
Chen et al.

(10) Patent No.: US 11,246,410 B2
(45) Date of Patent: Feb. 15, 2022

(54) SLIDE RAIL ASSEMBLY

(71) Applicants: KING SLIDE WORKS CO., LTD., Kaohsiung (TW); KING SLIDE TECHNOLOGY CO, LTD., Kaohsiung (TW)

(72) Inventors: Ken-Ching Chen, Kaohsiung (TW); Shun-Ho Yang, Kaohsiung (TW); Chi-Chih Chou, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 16/821,028

(22) Filed: Mar. 17, 2020

(65) Prior Publication Data

US 2021/0120951 A1 Apr. 29, 2021

(30) Foreign Application Priority Data

Oct. 28, 2019 (TW) ..... 108139154

(51) Int. Cl.
*A47B 88/477* (2017.01)
*A47B 88/49* (2017.01)
*A47B 88/443* (2017.01)

(52) U.S. Cl.
CPC ..... *A47B 88/477* (2017.01); *A47B 88/443* (2017.01); *A47B 88/49* (2017.01)

(58) Field of Classification Search
CPC ..... A47B 88/477; A47B 88/49; A47B 88/443
See application file for complete search history.

(56) References Cited

U.S. PATENT DOCUMENTS

| | | | | |
|---|---|---|---|---|
| 6,935,710 | B2 | 8/2005 | Chen et al. | |
| 7,404,611 | B1 | 7/2008 | Que | |
| 7,413,269 | B2 | 8/2008 | Chen et al. | |
| 8,585,164 | B2 | 11/2013 | Chen et al. | |
| 9,498,060 | B1 * | 11/2016 | Hsu | A47B 88/443 |
| 9,629,459 | B2 | 4/2017 | Chen et al. | |
| 9,681,749 | B2 | 6/2017 | Chen et al. | |
| 9,709,091 | B2 | 7/2017 | Chen et al. | |
| 9,992,906 | B2 | 6/2018 | Chen et al. | |
| 10,041,535 | B2 | 8/2018 | Chen et al. | |
| 10,334,950 | B2 * | 7/2019 | Chen | A47B 88/443 |

(Continued)

FOREIGN PATENT DOCUMENTS

| | | | |
|---|---|---|---|
| GB | 2417191 | B | 7/2006 |
| JP | 2018-042993 | A | 3/2018 |
| TW | 201811233 | A | 4/2018 |

*Primary Examiner* — Hanh V Tran
(74) *Attorney, Agent, or Firm* — Rosenberg, Klein & Lee

(57) ABSTRACT

A slide rail assembly includes a first rail, a second rail, a stop, and a working member. The second rail can be displaced with respect to the first rail. The stop is disposed on the first rail. The working member is movably mounted on the second rail. When reaching a predetermined position after being displaced with respect to the first rail from an extended position in a retracting direction, the second rail is blocked by the stop via the working member and is thus prevented from being displaced from the predetermined position in an opening direction. The slide rail assembly has a shorter length when the second rail is at the predetermined position than when the second rail is at the extended position.

16 Claims, 15 Drawing Sheets

(56) References Cited

U.S. PATENT DOCUMENTS

| | | | | |
|---|---|---|---|---|
| 10,342,341 | B2 | 7/2019 | Chen et al. | |
| 10,477,965 | B1 * | 11/2019 | Chen | H05K 7/183 |
| 10,694,847 | B2 * | 6/2020 | Chen | H05K 7/1489 |
| 10,736,422 | B2 * | 8/2020 | Chen | A47B 88/447 |
| 10,806,255 | B1 * | 10/2020 | Chen | A47B 88/443 |
| 10,918,209 | B1 * | 2/2021 | Chen | H05K 7/1489 |
| 2009/0001864 | A1 * | 1/2009 | Huang | A47B 88/49 312/333 |
| 2012/0061551 | A1 * | 3/2012 | Zhang | A47B 88/57 248/560 |
| 2018/0031037 | A1 * | 2/2018 | Chen | A47B 88/43 |
| 2018/0070723 | A1 * | 3/2018 | Chen | F16C 29/04 |
| 2019/0082836 | A1 * | 3/2019 | Chen | F16C 29/045 |
| 2019/0200759 | A1 * | 7/2019 | Chen | H05K 7/1489 |
| 2019/0274428 | A1 * | 9/2019 | Chen | H05K 7/1489 |
| 2020/0275576 | A1 * | 8/2020 | Chen | H05K 7/183 |
| 2020/0392990 | A1 * | 12/2020 | Chen | A47B 88/44 |

* cited by examiner

SLIDE RAIL ASSEMBLY

FIELD OF THE INVENTION

The present invention relates to a slide rail assembly and more particularly to a slide rail assembly that can be of different lengths to adapt to different environments.

BACKGROUND OF THE INVENTION

Generally, a slide rail assembly includes at least two slide rails that can be displaced with respect to each other to bring the slide rail assembly into an extended or retracted state.

In U.S. Pat. No. 7,404,611 B1, for example, a drawer slide with locks includes a chassis member (i.e., the inner rail), an intermediate member (i.e., the intermediate rail), and a cabinet member (i.e., the outer rail). The intermediate member, when at an extended position with respect to the cabinet member, is blocked between a forward stop and a rearward stop of the cabinet member via a rear lock and is thus kept at the extended position. The rear lock can be moved from between the forward stop and the rearward stop by retracting the chassis member with respect to the intermediate member. More specifically, the rear lock includes a lock pin and a torsion spring. The lock pin is resiliently biased by the torsion spring and is configured to be blocked between the forward stop and the rearward stop of the cabinet member.

As another example, the slide rail assembly disclosed in U.S. Pat. No. 7,980,641 B2 includes an outer slide rail, an intermediate slide rail, and an inner slide rail. The outer slide rail has a protrusion. The intermediate slide rail is provided with a latch member and a resilient member. The inner slide rail has a stop portion. When the inner slide rail is pulled in an opening direction with respect to the intermediate slide rail, the stop portion of the inner slide rail engages with the latch member of the intermediate slide rail such that the intermediate slide rail can be pulled with respect to the outer slide rail in the opening direction (see FIG. 5 of the '641 patent). Once the intermediate slide rail reaches a predetermined position after being pulled, or displaced, in the opening direction, the latch member of the intermediate slide rail engages with an inclined surface of the protrusion of the outer slide rail, resulting in a force that drives the latch member out of engagement with the stop portion of the inner slide rail (see FIG. 6 of the '641 patent). It can be known from the above that the engagement between the stop portion and the latch member enables simultaneous displacement of the inner slide rail and the intermediate slide rail in the opening direction, and that the simultaneous displacement relationship between the inner slide rail and the intermediate slide rail can be terminated by means of the inclined surface of the protrusion of the outer slide rail. The resilient member of the intermediate slide rail is substantially R-shaped, is made of a metal wire, and biases the latch member resiliently in order to keep the latch member at a predetermined position.

As user needs vary, it is important to develop a slide rail product that is different from the foregoing and suitable for use in a narrow space.

SUMMARY OF THE INVENTION

The present invention provides a slide rail assembly that can be of different lengths to facilitate use in a narrow space.

According to one aspect of the present invention, a slide rail assembly includes a first rail, a second rail, a first stop, and a working member. The second rail can be longitudinally displaced with respect to the first rail. The first stop is disposed on the first rail. The working member is movably mounted on the second rail. When the second rail reaches a predetermined position after being displaced with respect to the first rail from an extended position in a retracting direction, the first stop blocks the second rail through the working member to prevent the second rail from being displaced from the predetermined position in an opening direction. The slide rail assembly has a first length when the second rail is at the extended position. The slide rail assembly has a second length shorter than the first length when the second rail is at the predetermined position.

Preferably, the second rail includes a first wall, a second wall, and a longitudinal wall connected between the first wall and the second wall of the second rail, and the slide rail assembly further includes a shaft that pivotally connects the working member to the longitudinal wall of the second rail in a transverse direction.

Preferably, the working member is provided with a working portion. When the second rail is at the predetermined position with respect to the first rail, the first stop blocks the working member through the working portion to prevent the second rail from being displaced from the predetermined position in the opening direction.

Preferably, the longitudinal wall of the second rail has a first position-limiting wall section, a second position-limiting wall section, and an extension hole defined between the first position-limiting wall section and the second position-limiting wall section, wherein the extension hole allows the working portion to extend therethrough.

Preferably, the slide rail assembly further includes an elastic structure for applying an elastic force to the working member.

Preferably, the slide rail assembly further includes a second stop disposed on the first rail. When the second rail is at the predetermined position with respect to the first rail, the second stop blocks the working member through the working portion to prevent the second rail from being displaced from the predetermined position in the retracting direction.

Preferably, the slide rail assembly further includes a third rail that can be longitudinally displaced with respect to the second rail, and the second rail is movably mounted between the first rail and the third rail.

Preferably, the working portion has a columnar configuration.

Preferably, the slide rail assembly further includes a blocking structure disposed on the first rail and an engaging member movably mounted on the second rail. When the second rail reaches the extended position after being displaced with respect to the first rail from a retracted position in the opening direction, the blocking structure blocks the second rail through the engaging member to prevent the second rail from being displaced from the extended position in the retracting direction.

Preferably, the slide rail assembly further includes a pivotal connection member for pivotally connecting the engaging member to the longitudinal wall of the second rail in a height direction, wherein the height direction is substantially perpendicular to the transverse direction.

Preferably, the slide rail assembly further includes an elastic feature for applying an elastic force to the engaging member.

Preferably, the slide rail assembly further includes an operating member disposed on one of the first rail and the second rail, and the operating member is configured to be operated in order to drive the engaging member and thereby free the engaging member from blockage by the blocking structure.

According to another aspect of the present invention, a slide rail assembly includes a first rail, a second rail, a third rail, a first stop, a blocking structure, an engaging member, and a working member. The second rail can be displaced with respect to the first rail, and the third rail can be displaced with respect to the second rail. The first stop is disposed on the first rail, and so is the blocking structure. The engaging member is movably mounted on the second rail, and so is the working member. When the second rail reaches an extended position after being displaced with respect to the first rail in an opening direction, the blocking structure blocks the second rail through the engaging member to prevent the second rail from being displaced from the extended position in a retracting direction. Once the blocking relationship between the engaging member and the blocking structure is terminated and the second rail is displaced with respect to the first rail from the extended position in the retracting direction and reaches a predetermined position, the first stop blocks the second rail through the working member to prevent the second rail from being displaced from the predetermined position in the opening direction.

DETAILED DESCRIPTION OF THE INVENTION

Figure 1:
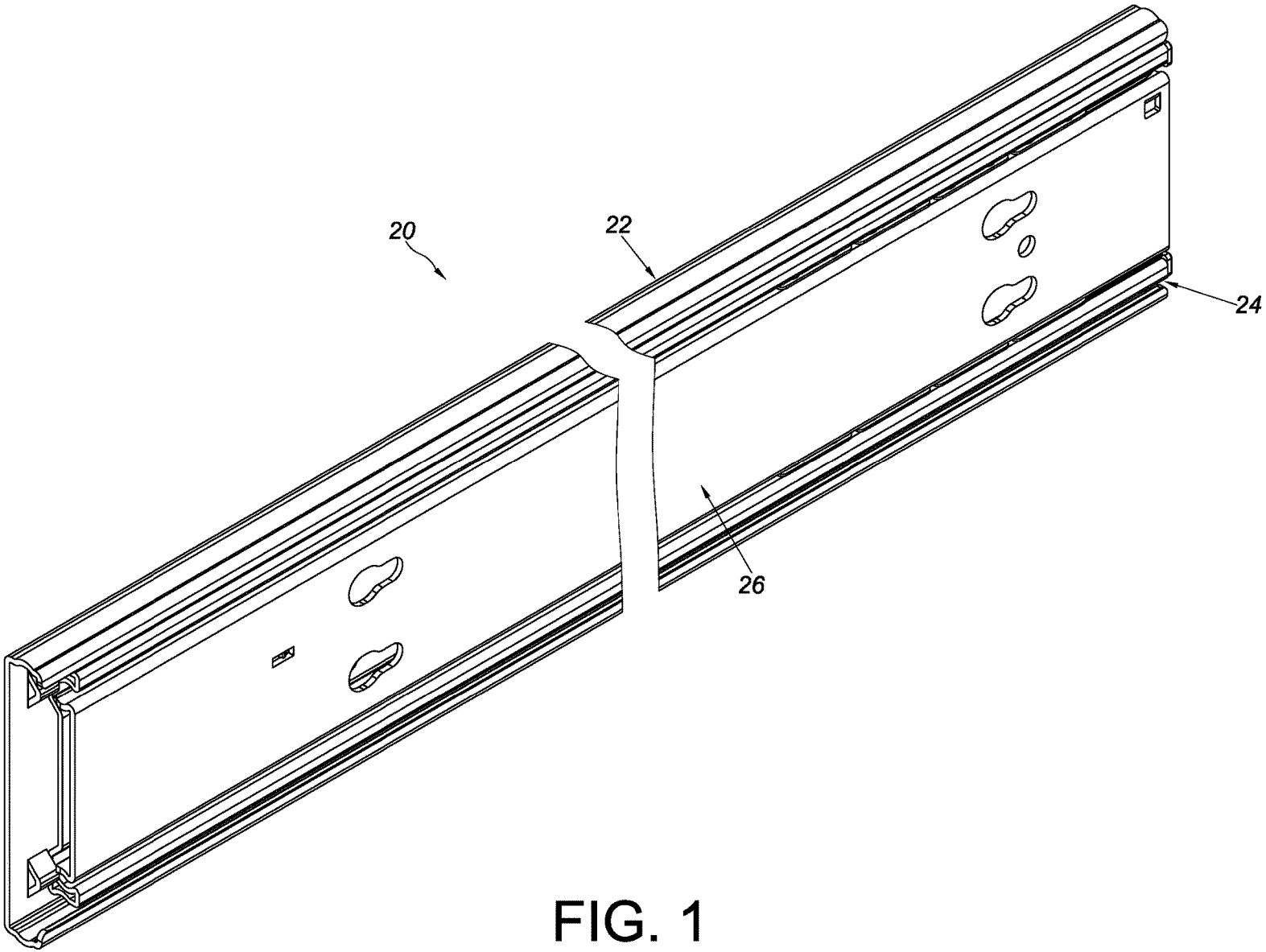
FIG. 1 is a perspective view of the slide rail assembly according to an embodiment of the present invention.
Figure 2:
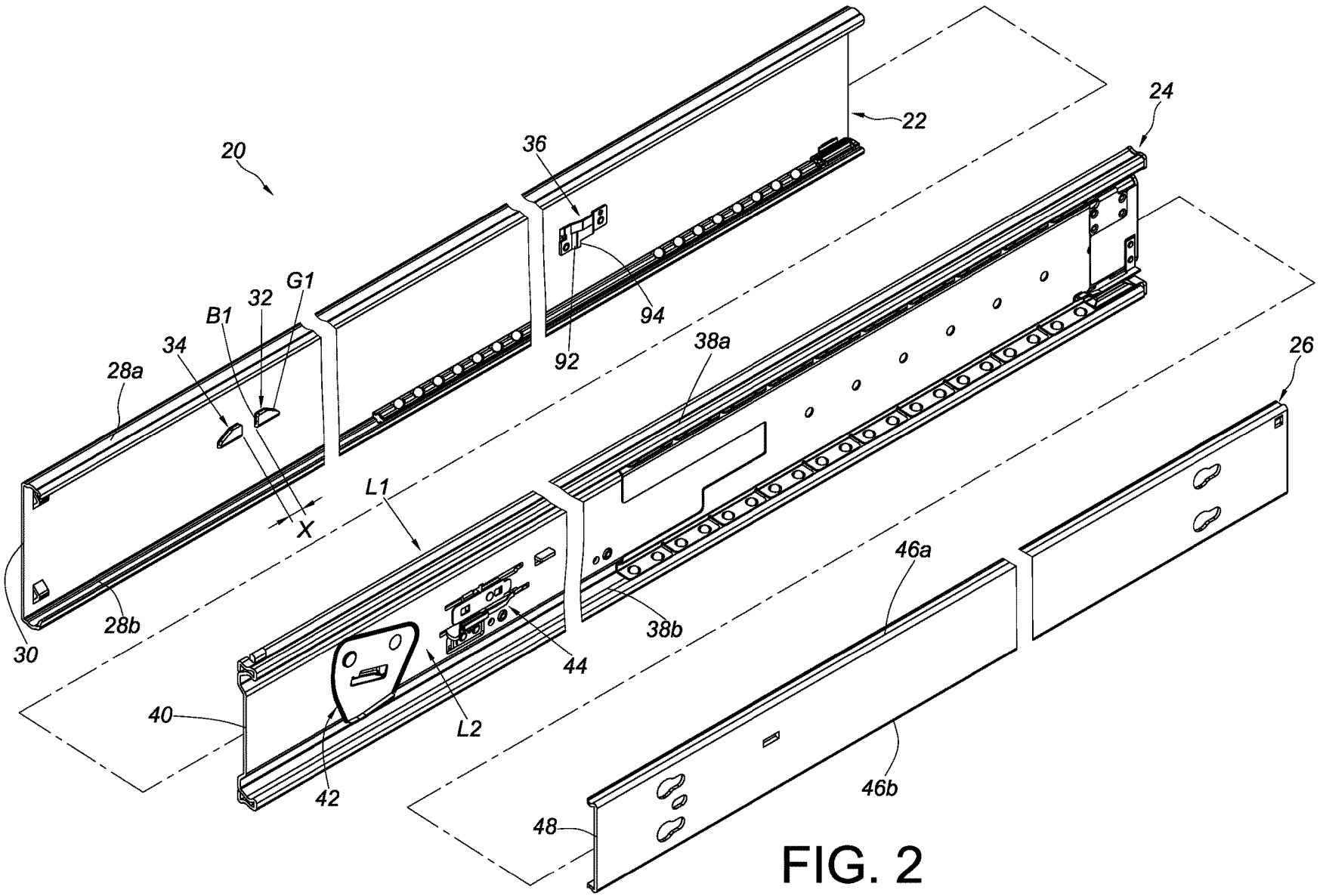
FIG. 2 is an exploded perspective view of the slide rail assembly according to the embodiment of the present invention, showing that the slide rail assembly includes a first rail, a second rail, and a third rail.

Referring to FIG. 1 and FIG. 2, the slide rail assembly 20 according to an embodiment of the present invention includes a first rail 22, a second rail 24, and a third rail 26.

The first rail 22 includes a first wall 28*a*, a second wall 28*b*, and a longitudinal wall 30 connected between the first wall 28*a* and the second wall 28*b* of the first rail 22. The first wall 28*a*, the second wall 28*b*, and the longitudinal wall 30 of the first rail 22 jointly define a first channel for receiving the second rail 24. Preferably, the slide rail assembly 20 further includes a first stop 32, a second stop 34, and a blocking structure 36, all disposed on the longitudinal wall 30 of the first rail 22. The first stop 32 and the second stop 34 define a receiving space X therebetween. Preferably, the first stop 32 and the second stop 34 are symmetrically arranged and have substantially the same structural configuration. Take the first stop 32 for example. The first stop 32 has a first guiding portion G1 and a first blocking portion B1 adjacent to the first guiding portion G1. The first guiding portion G1 includes an inclined surface or a curved surface, and the first blocking portion B1 is a vertical wall. Implementation of the first guiding portion G1 and the first blocking portion B1, however, is not limited to the foregoing.

The second rail 24 is movably mounted between the first rail 22 and the third rail 26. The second rail 24 can be longitudinally displaced with respect to the first rail 22. The second rail 24 includes a first wall 38*a*, a second wall 38*b*, and a longitudinal wall 40 connected between the first wall 38*a* and the second wall 38*b* of the second rail 24. The first wall 38*a*, the second wall 38*b*, and the longitudinal wall 40 of the second rail 24 jointly define a second channel for receiving the third rail 26. Preferably, the slide rail assembly 20 further includes a working member 42 and an engaging member 44, both movably mounted on the longitudinal wall 40 of the second rail 24.

The third rail 26 can be longitudinally displaced with respect to the second rail 24. The third rail 26 includes a first wall 46*a*, a second wall 46*b*, and a longitudinal wall 48 connected between the first wall 46*a* and the second wall 46*b* of the third rail 26.

Figure 3:
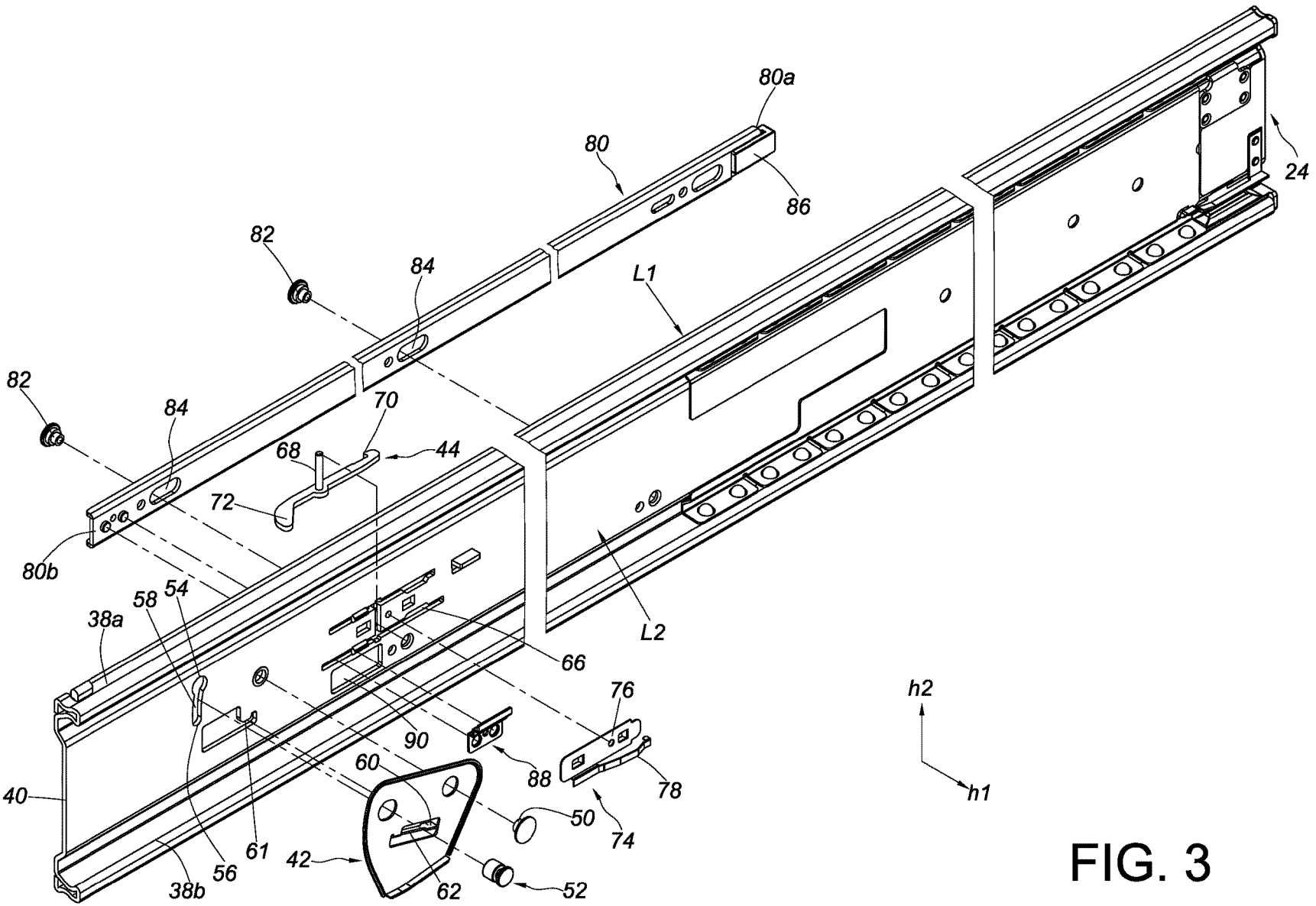
FIG. 3 is an exploded perspective view of the second rail of the slide rail assembly according to the embodiment of the present invention, showing in particular the slide rail components of the second rail.
Figure 4:
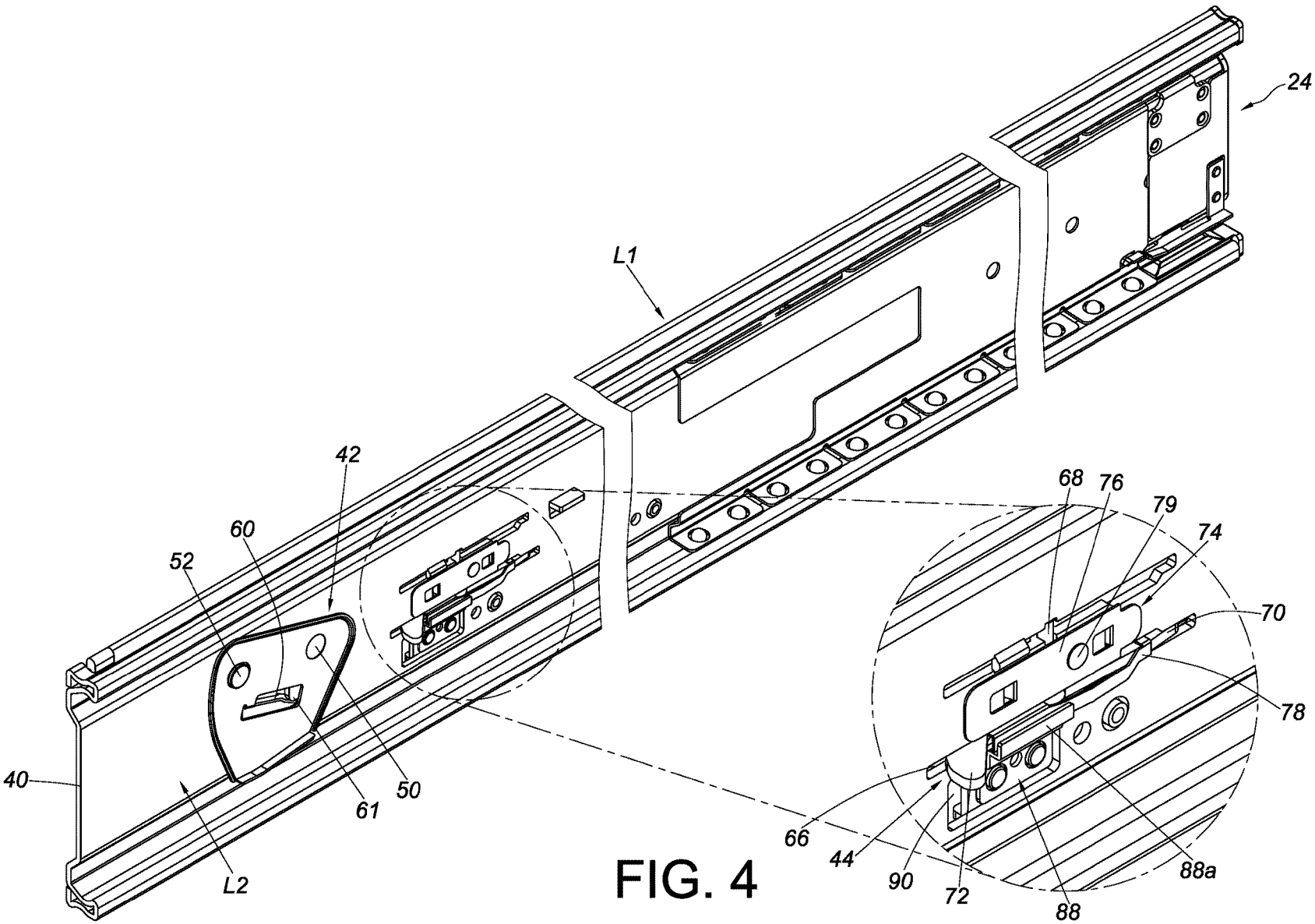
FIG. 4 shows one side of the second rail of the slide rail assembly according to the embodiment of the present invention.
Figure 5:
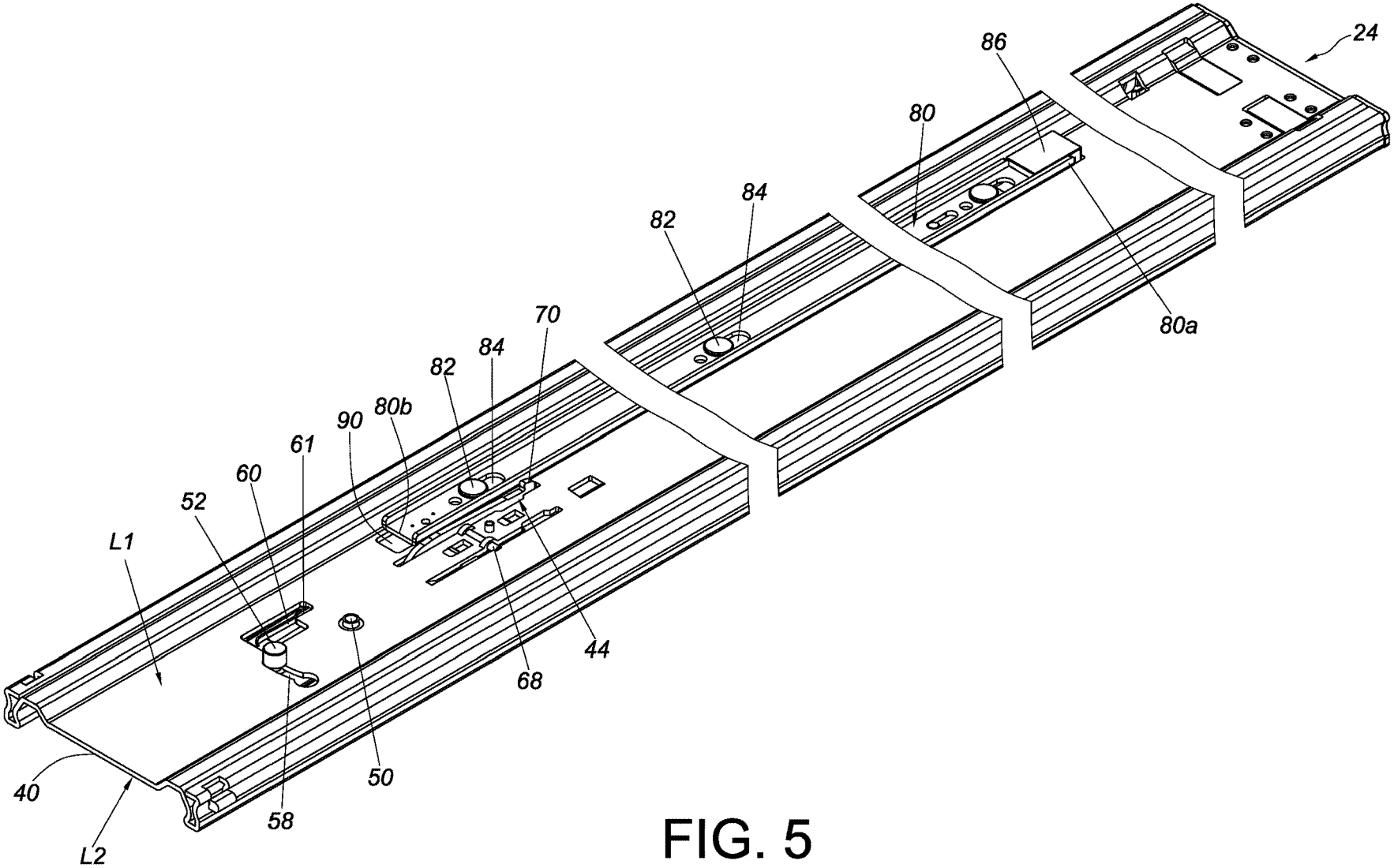
FIG. 5 shows the other side of the second rail of the slide rail assembly according to the embodiment of the present invention.

As shown in FIG. 3, FIG. 4, and FIG. 5, the longitudinal wall 40 of the second rail 24 has a first side L1 and a second side L2, which is the opposite side of the first side L1. The first side L1 of the second rail 24 faces the first rail 22 while the second side L2 of the second rail 24 faces the third rail 26.

Preferably, the slide rail assembly 20 further includes a shaft 50, and the shaft 50 pivotally connects the working member 42 to the second side L2 of the longitudinal wall 40 of the second rail 24 in a transverse direction h1.

Preferably, the working member 42 is provided with a working portion 52, and the working portion 52 has a columnar configuration. It is worth mentioning that the working portion 52 may be an independent component mounted on the working member 42 or be directly integrated with the working member 42; the present invention has no limitation in this regard.

Preferably, the longitudinal wall 40 of the second rail 24 has a first position-limiting wall section 54, a second position-limiting wall section 56, and an extension hole 58 defined between the first position-limiting wall section 54 and the second position-limiting wall section 56. The extension hole 58 brings the first side L1 and the second side L2 of the second rail 24 into communication. The extension hole 58 allows the working portion 52 to extend therethrough. For example, the working portion 52 is inserted into the extension hole 58 from the second side L2 of the second rail 24 and extends to the first side L1 of the second rail 24.

Preferably, the slide rail assembly 20 further includes an elastic structure 60 for applying an elastic force to the working member 42. Here, the elastic structure 60 is an elastic leg formed on the working member 42 by way of example. In an alternative embodiment, the elastic structure 60 may be an independent elastic component capable of applying an elastic force. The present invention has no limitation as to whether the elastic structure 60 is a separate component or not. The elastic structure 60 is supported between the working member 42 and a supporting feature 61 of the longitudinal wall 40 of the second rail 24.

Preferably, the elastic structure 60 lies in a space 62 of the working member 42, and the shaft 50 and the working portion 52 are located respectively on two opposite sides of, substantially higher than, the elastic structure 60.

Preferably, the longitudinal wall 40 of the second rail 24 further includes a mounting hole 66 that brings the first side L1 and the second side L2 of the second rail 24 into communication. The mounting hole 66 is configured to receive the engaging member 44. The engaging member 44 is pivotally connected to the longitudinal wall 40 of the second rail 24 by a pivotal connection member 68 in a height direction h2. The height direction h2 and the transverse direction h1 are substantially perpendicular to each other.

Preferably, the engaging member 44 includes an engaging portion 70 and a disengaging portion 72, and the pivotal connection member 68 is disposed between the engaging portion 70 and the disengaging portion 72.

Preferably, the slide rail assembly 20 further includes an elastic feature 74 for applying an elastic force to the engaging member 44. Here, by way of example, the elastic feature 74 has a body portion 76 and an elastic portion 78 extending from the body portion 76. The body portion 76 is connected to the second side L2 of the longitudinal wall 40 of the second rail 24 by a fixing member 79 (see FIG. 4). The body portion 76 is configured to keep the pivotal connection member 68 inside the longitudinal wall 40 of the second rail 24. The elastic portion 78 is, for example, an elastic arm or an elastic leg. The elastic portion 78 is configured to resiliently bias a portion of the engaging member 44 and is adjacent to the engaging portion 70 of the engaging member 44. The engaging member 44 responds to the elastic force of the elastic portion 78 by keeping the engaging portion 70 of the engaging member 44 facing the longitudinal wall 30 of the first rail 22.

Preferably, the slide rail assembly 20 further includes an operating member 80 disposed on one of the first rail 22 and the second rail 24. Here, the operating member 80 is disposed on the first side L1 of the longitudinal wall 40 of the second rail 24 by way of example only.

Preferably, the operating member 80 has a longitudinal length. One of the operating member 80 and the second rail 24 is provided with a plurality of connecting features, and the other of the operating member 80 and the second rail 24 is provided with a plurality of corresponding features configured to work with the connecting features respectively. For example, each connecting feature is a protruding member 82, and each corresponding feature is a bounded longitudinal slot 84. Each protruding member 82 extends through a portion of the corresponding longitudinal slot 84 and thereby mounts the operating member 80 to the first side L1 of the second rail 24 in a way that allows the operating member 80 to be moved within a limited range with respect to the second rail 24 when operated.

Preferably, the operating member 80 has an operating portion 86 and a driving portion 88, which are respectively adjacent to a first end 80*a* and a second end 80*b* of the operating member 80. The driving portion 88 may be an independent component mounted on the operating member 80 or be directly integrated with the operating member 80; the present invention has no limitation in this regard. The longitudinal wall 40 of the second rail 24 further includes an opening 90 that brings the first side L1 and the second side L2 of the second rail 24 into communication, and the driving portion 88 extends from the first side L1 of the second rail 24 to the second side L2 through the opening 90. The driving portion 88 has a driving feature 88*a* corresponding in position to the disengaging portion 72 of the engaging member 44.

Figure 6:
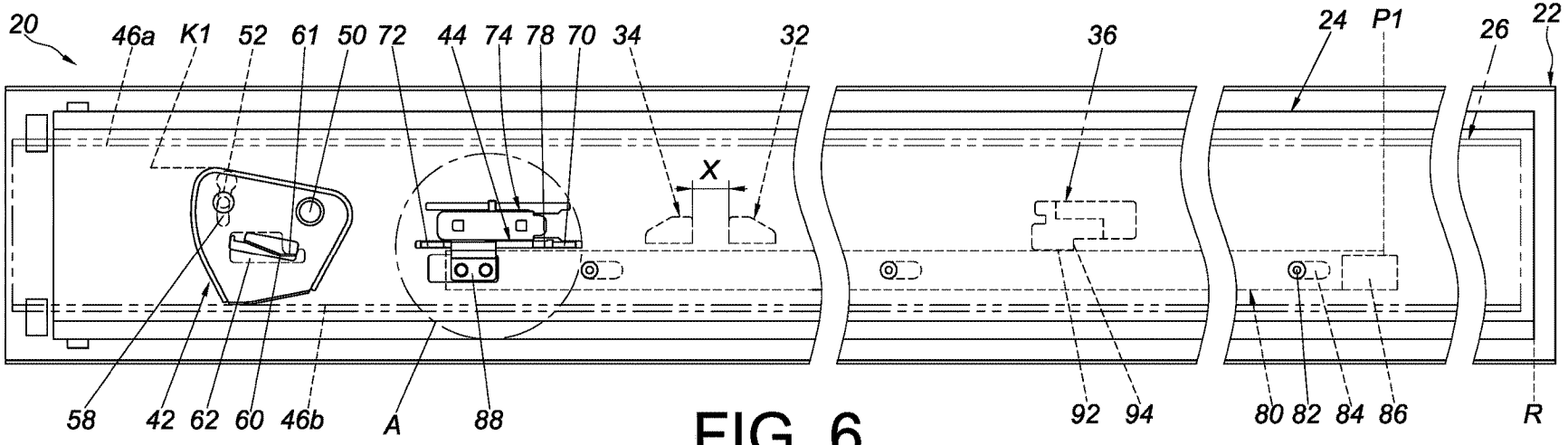
FIG. 6 is a schematic drawing showing that the slide rail assembly according to the embodiment of the present invention is in a retracted state.
Figure 7:
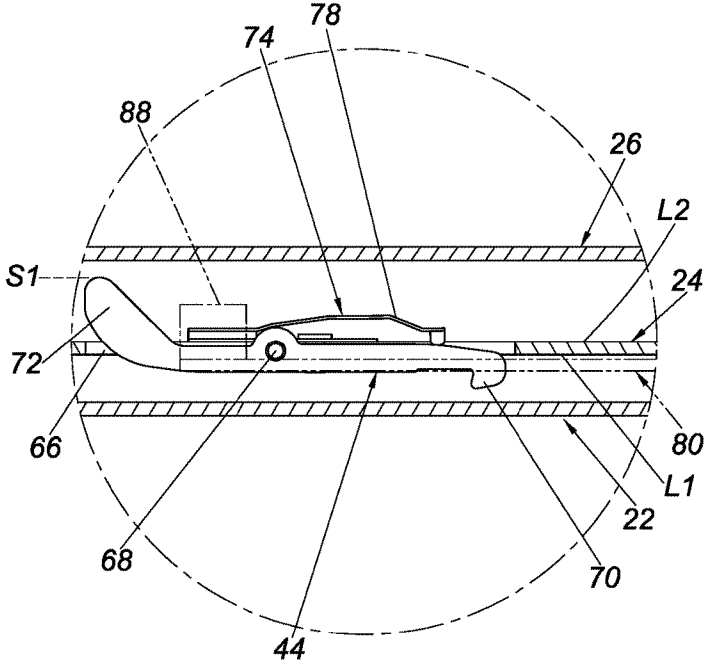
FIG. 7 is a sectional view of the circled area A in FIG. 6.

FIG. 6 and FIG. 7 show the slide rail assembly 20 in a retracted state in which the second rail 24 is at a retracted position R with respect to the first rail 22 and the third rail 26 is retracted with respect to the second rail 24.

More specifically, the engaging member 44 stays in a first state S1 in response to the elastic portion 78 of the elastic feature 74 applying an elastic force. In addition, the operating member 80 is at a first position P1, with the driving portion 88 (or more particularly its driving feature 88*a*) corresponding in position to the disengaging portion 72 of the engaging member 44. The working member 42 is supported by the second wall 46*b* of the third rail 26 and is thus kept in a first working state K1, in which the elastic structure 60 accumulates an elastic force. When the working member 42 is in the first working state K1, the working portion 52 of the working member 42 is offset in position from the two stops 32 and 34 in the height direction h2 shown in FIG. 3. Moreover, not only do the first stop 32 and the second stop 34 define the receiving space X therebetween, but there is also a predetermined longitudinal distance between the first stop 32 and the blocking structure 36.

Figure 8:
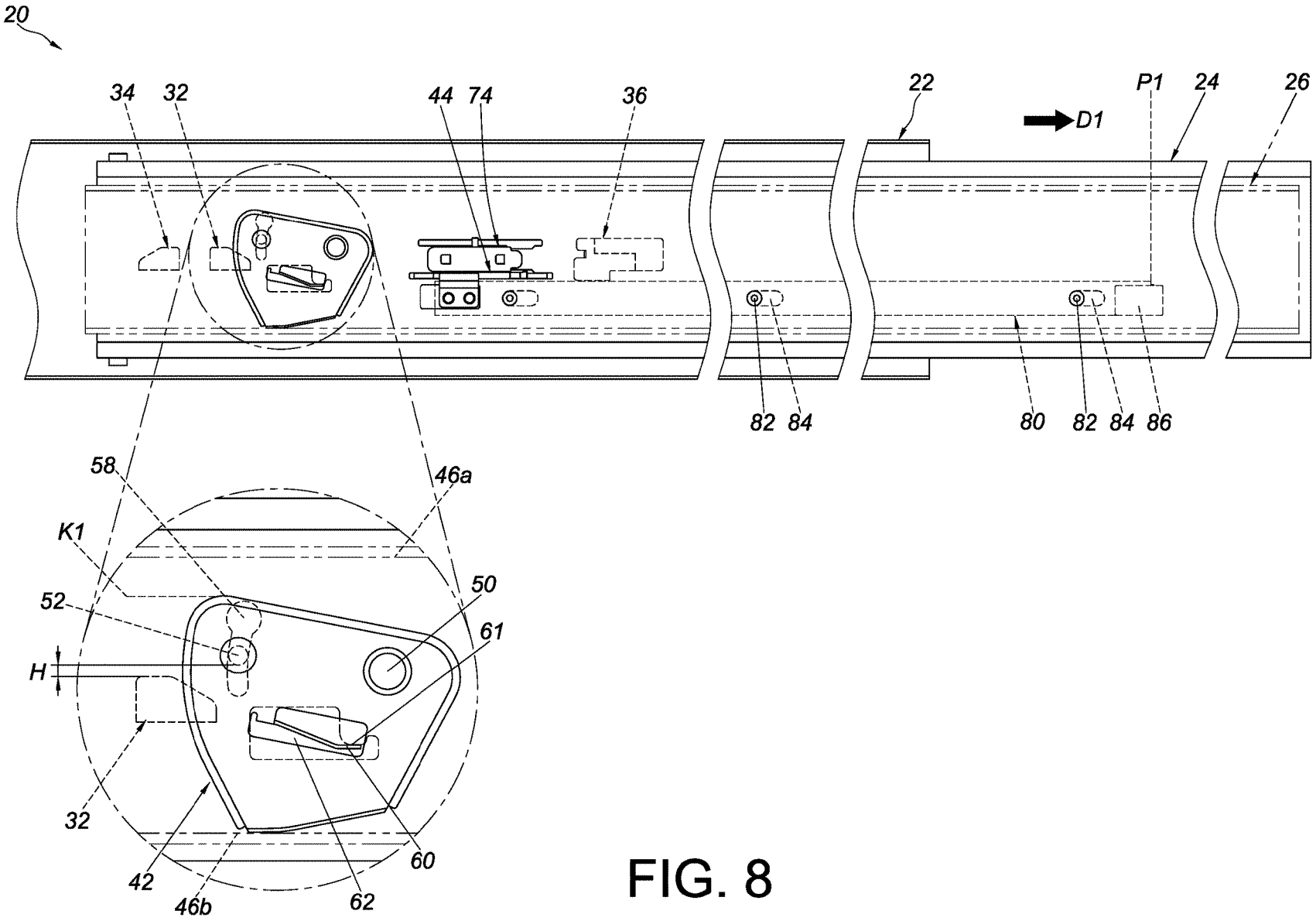
FIG. 8 is a schematic drawing showing that the second rail of the slide rail assembly according to the embodiment of the present invention is displaced along with the third rail in an opening direction with respect to the first rail.

Referring to FIG. 8, the second rail 24 can be displaced with respect to the first rail 22 from the retracted position R in an opening direction D1. With the working member 42 in the first working state K1 (i.e., with the working portion 52 of the working member 42 offset from the two stops 32 and 34 by a height difference H), the working portion 52 of the working member 42 can move past the second stop 34 and the first stop 32 in the opening direction D1 when the second rail 24 is displaced in the opening direction D1. Preferably, there is a synchronization mechanism (not shown) that allows the second rail 24 and the third rail 26 to be displaced in unison in the opening direction D1. As the principle underlying the establishment and termination of the simultaneous displacement relationship between the second rail 24 and the third rail 26 is comprehensible to a person of ordinary skill in the art, further description of the principle is omitted herein for the sake of brevity.

Figure 9:
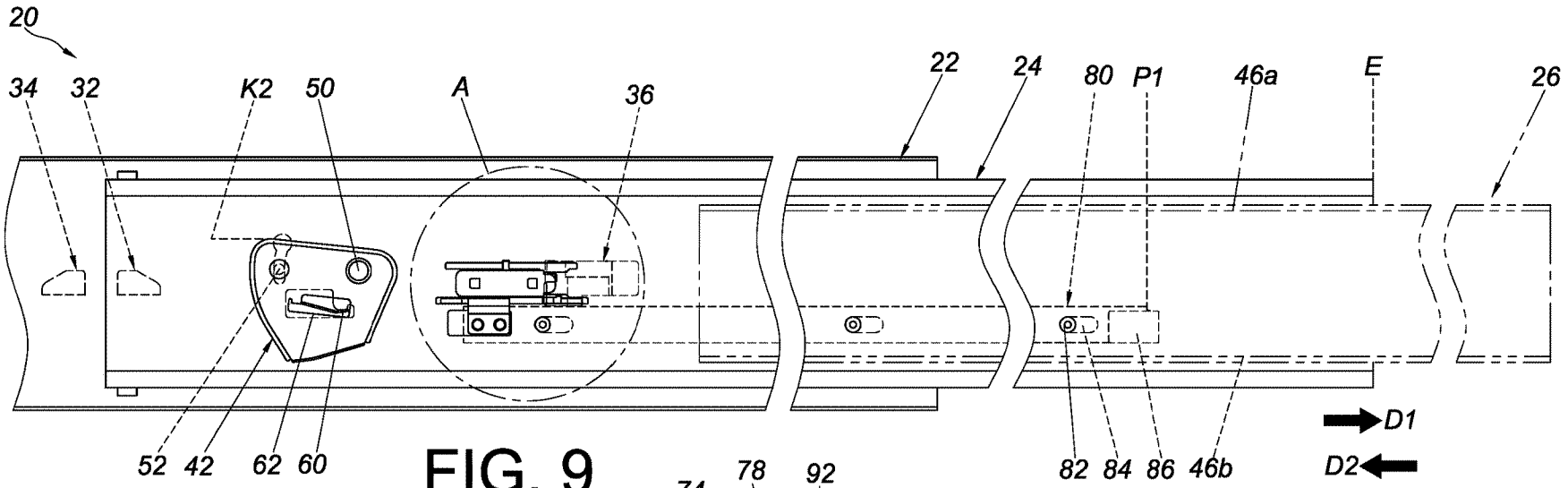
FIG. 9 is a schematic drawing showing that the second rail of the slide rail assembly according to the embodiment of the present invention is at an extended position with respect to the first rail, and that the third rail can be displaced with respect to the second rail in the opening direction.
Figure 10:
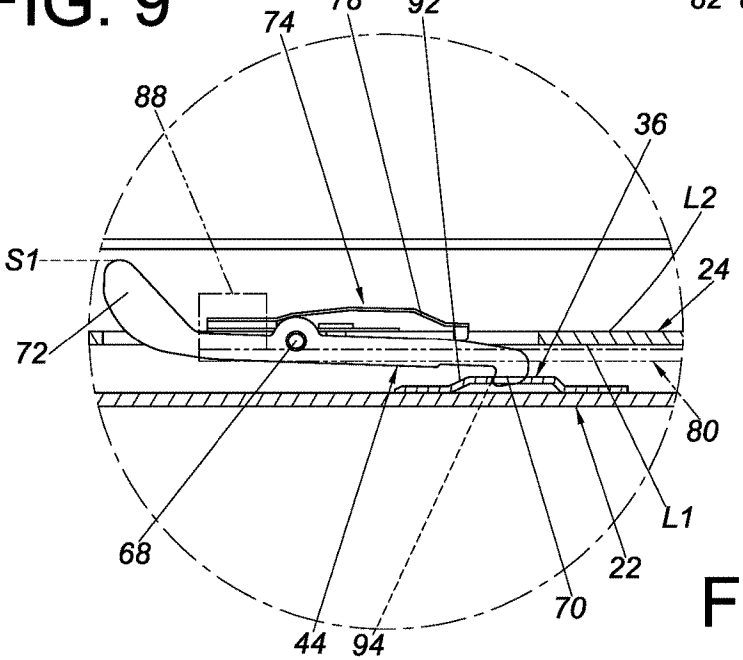
FIG. 10 is a sectional view of the circled area A in FIG. 9.

When the second rail 24 reaches an extended position E after being further displaced with respect to the first rail 22 in the opening direction D1, referring to FIG. 9 and FIG. 10, the blocking structure 36 of the first rail 22 blocks the second rail 24 through the engaging member 44 and thereby prevents the second rail 24 from being displaced with respect to the first rail 22 from the extended position E in a retracting direction D2.

More specifically, referring back to FIG. 2, the blocking structure 36 includes a guiding section 92 and a blocking section 94 adjacent to the guiding section 92, wherein the guiding section 92 includes, for example, an inclined surface or a curved surface. In the course in which the second rail 24 is displaced with respect to the first rail 22 to the extended position E in the opening direction D1, the engaging portion 70 of the engaging member 44 is guided uphill by the guiding section 92 of the blocking structure 36 such that the elastic portion 78 of the elastic feature 74 accumulates an elastic force. As soon as the engaging portion 70 of the engaging member 44 reaches the blocking section 94 of the blocking structure 36, the elastic portion 78 of the elastic feature 74 releases the elastic force accumulated therein to bring the engaging portion 70 of the engaging member 44 into engagement with the blocking section 94 of the blocking structure 36; wherein, the engaging member 44 is in the first state S1, and the second rail 24 is at the extended position E. The second rail 24 in this state cannot be displaced with respect to the first rail 22 from the extended position E in the retracting direction D2. The third rail 26, on the other hand, can be further displaced in the opening direction D1 with respect to the second rail 24 at the extended position E to extend the slide rail assembly 20 even further.

It is worth mentioning that once the second wall 46*b* of the third rail 26 stops supporting the working member 42, the working member 42 is switched from the first working state K1 to a second working state K2 by the elastic force released by the elastic structure 60. In the second working state K2, the working portion 52 of the working member 42 is no longer offset from the two stops 32 and 34 by the height difference H shown in FIG. 8.

Figure 11:
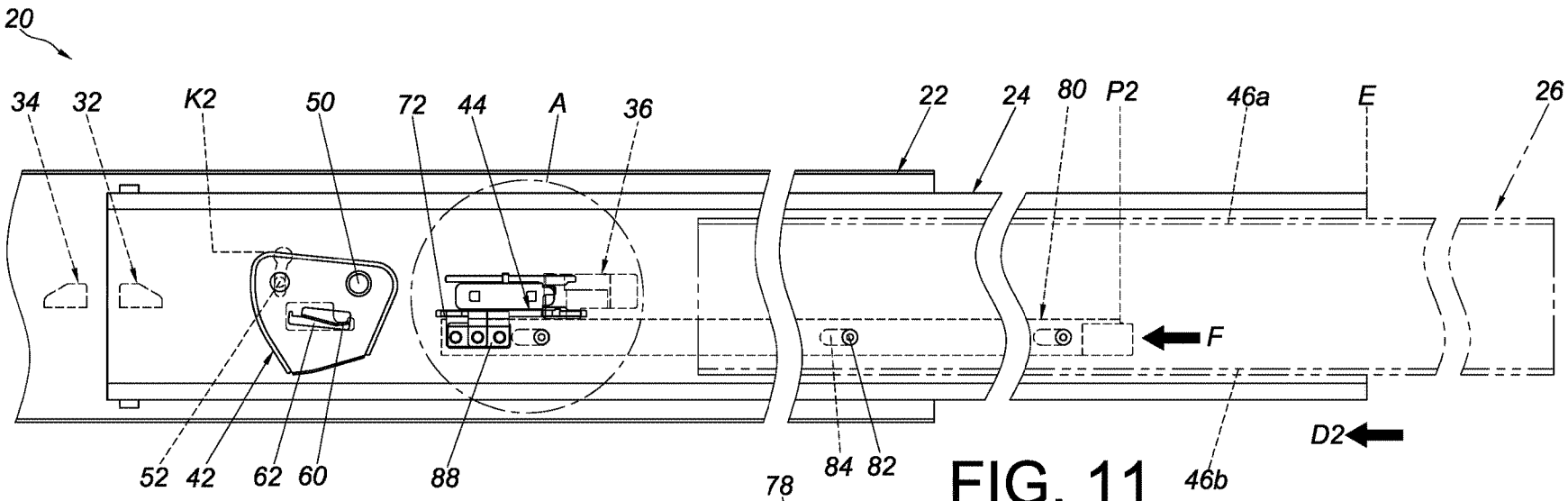
FIG. 11 is a schematic drawing showing that the second rail of the slide rail assembly according to the embodiment of the present invention is at the extended position with respect to the first rail, and that an operating member can be operated to allow displacement of the second rail in a retracting direction.
Figure 12:
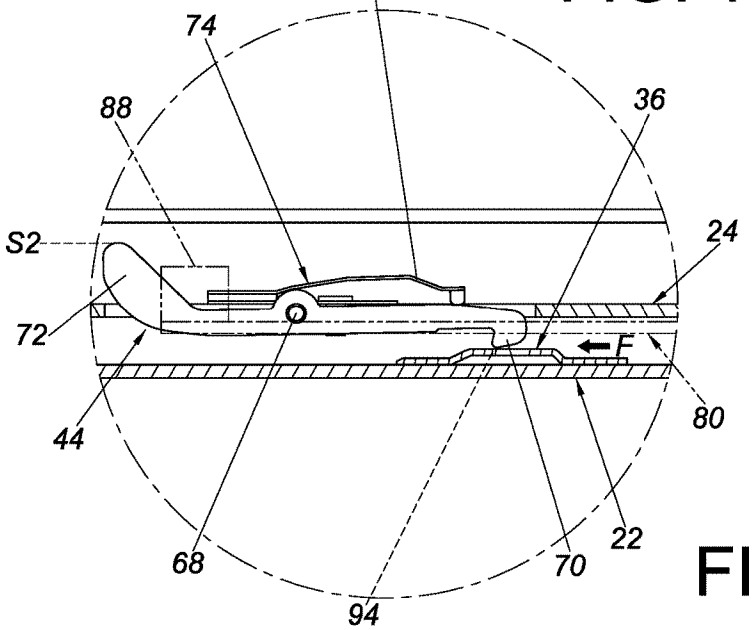
FIG. 12 is a sectional view of the circled area A in FIG. 11.

Referring to FIG. 11 and FIG. 12, the operating member 80 can be operated to drive the engaging member 44 and thereby free the engaging member 44 from blockage by the blocking structure 36. More specifically, a user may apply a force F to the operating member 80 to displace the operating member 80 from the first position P1 to a second position P2, the objective being for the driving portion 88 of the operating member 80 to switch the engaging member 44 from the first state S1 to a second state S2 through contact with the disengaging portion 72 of the engaging member 44, thereby disengaging the engaging portion 70 of the engaging member 44 from the blocking section 94 of the blocking structure 36 (i.e., terminating the blocking relationship between the engaging member 44 and the blocking structure 36), allowing the second rail 24 to be displaced with respect to the first rail 22 from the extended position E in the retracting direction D2.

Figure 13:
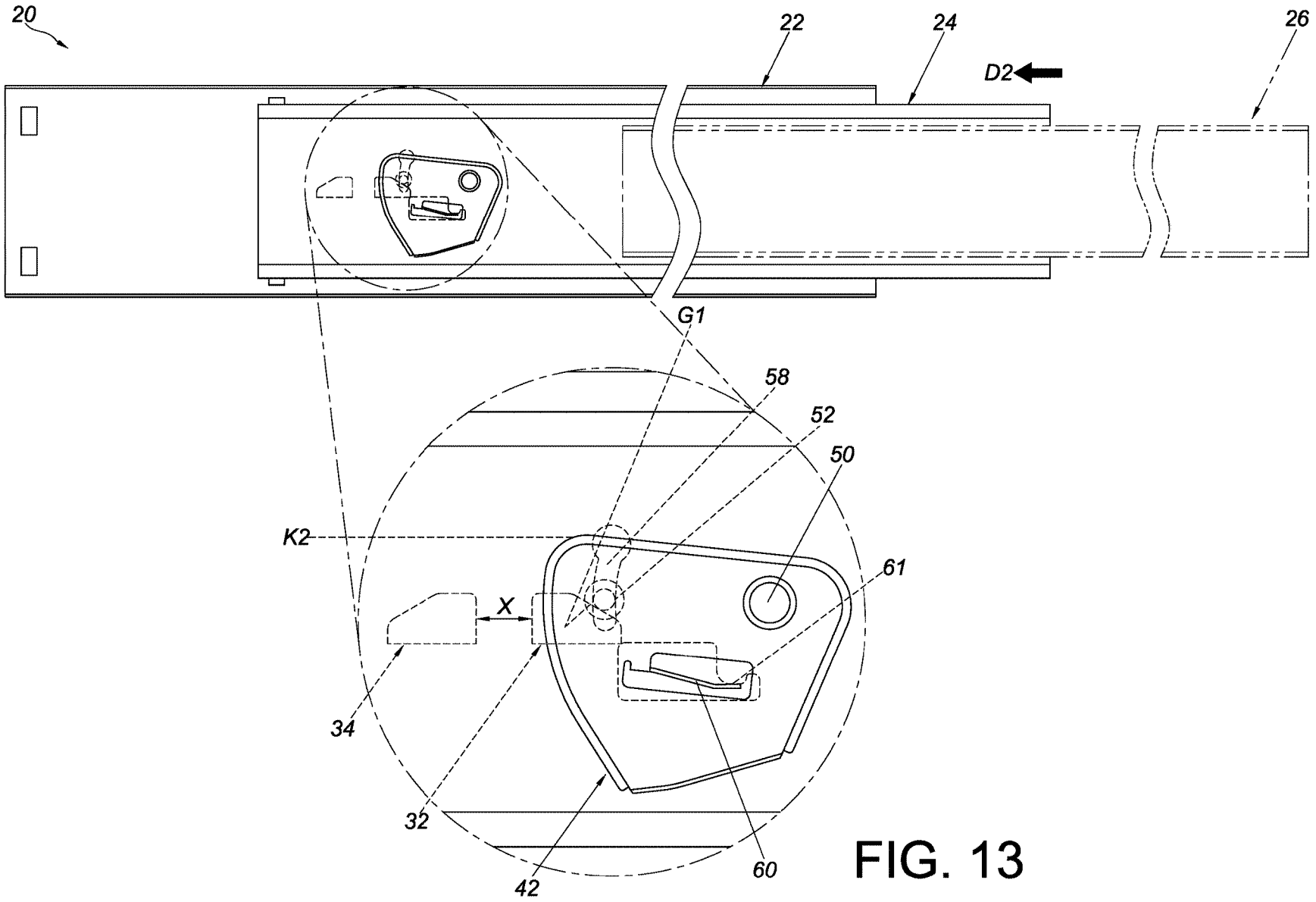
FIG. 13 is a schematic drawing showing that the second rail of the slide rail assembly according to the embodiment of the present invention is displaced with respect to the first rail from the extended position in the retracting direction.
Figure 14:
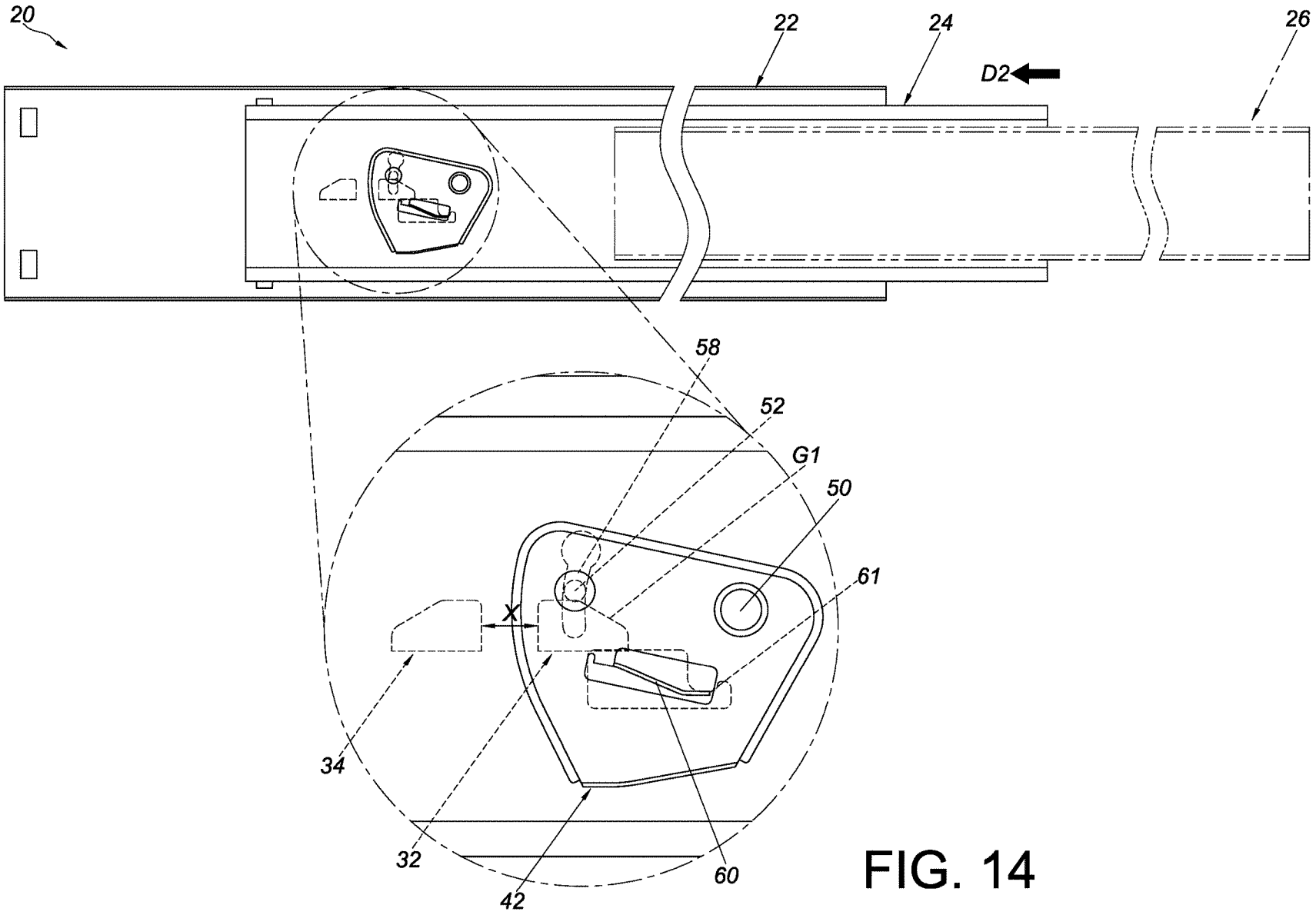
FIG. 14 is a schematic drawing showing that the second rail of the slide rail assembly according to the embodiment of the present invention is further displaced with respect to the first rail in the retracting direction.
Figure 15:
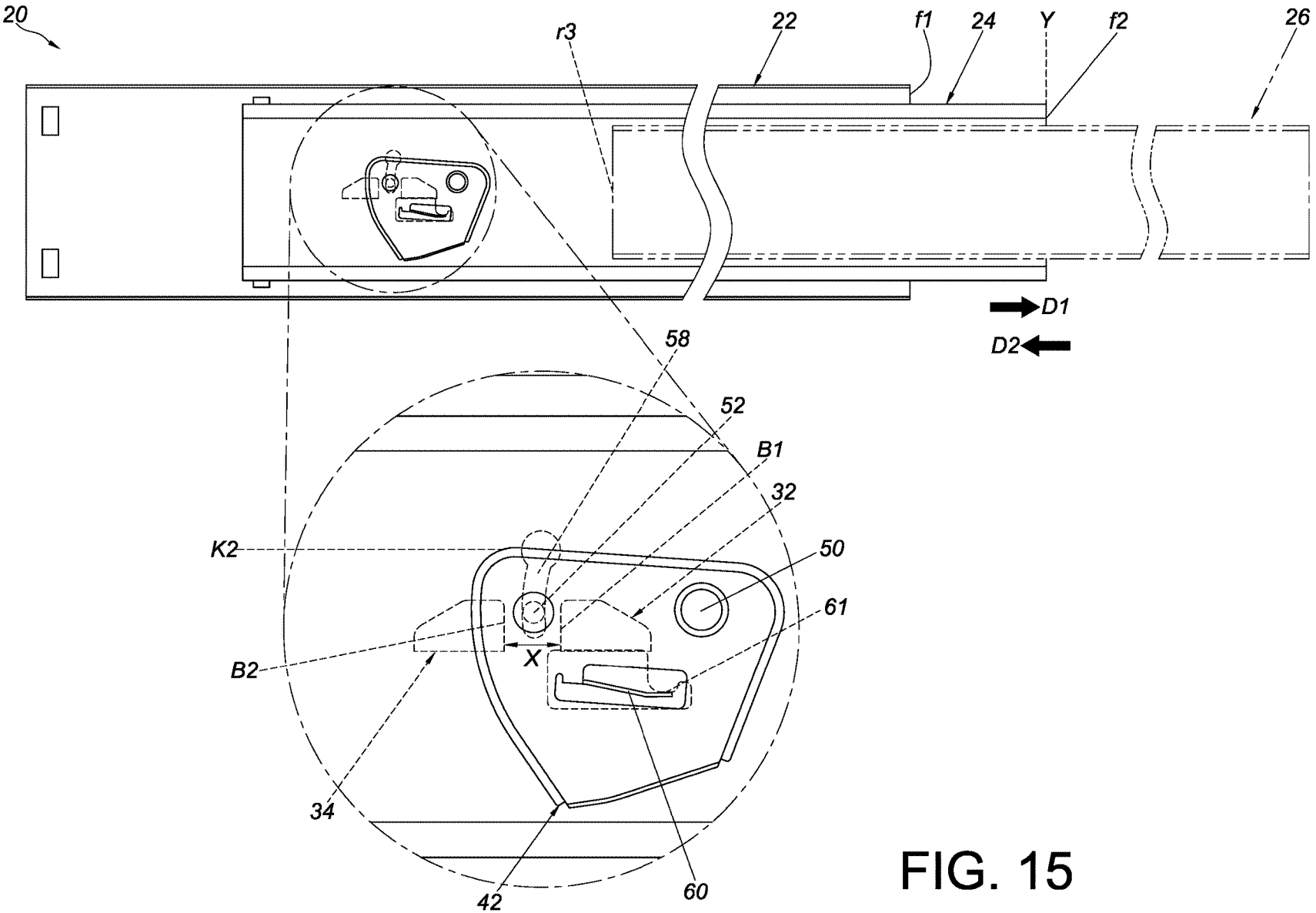
FIG. 15 is a schematic drawing showing that the second rail of the slide rail assembly according to the embodiment of the present invention is further displaced with respect to the first rail in the retracting direction and reaches a predetermined position.

In the course in which the second rail 24 is displaced with respect to the first rail 22 from the extended position E to a predetermined position Y in the retracting direction D2, referring to FIG. 13, FIG. 14, and FIG. 15, the working portion 52 of the working member 42 (now in the second working state K2) comes into contact with the first guiding portion G1 of the first stop 32 of the first rail 22 (see FIG. 13). With the working portion 52 guided by the first guiding portion G1 of the first stop 32, the working member 42 is rotated through an angle such that the elastic structure 60 accumulates an elastic force (see FIG. 14). Once the working portion 52 of the working member 42 corresponds in position to the receiving space X between the first stop 32 and the second stop 34, the working member 42 enters the second working state K2 (see FIG. 15) in response to the elastic structure 60 releasing the elastic force accumulated therein. The working portion 52 of the working member 42 ends up in the receiving space X and blocked between the first blocking portion B1 of the first stop 32 and the second blocking portion B2 of the second stop 34.

When the second rail 24 is at the predetermined position Y with respect to the first rail 22, referring to FIG. 15, the first stop 32 blocks the second rail 24 through the working portion 52 of the working member 42 and thereby prevents the second rail 24 from being displaced from the predetermined position Y in the opening direction D1, or the second stop 34 blocks the second rail 24 through the working portion 52 of the working member 42 and thereby prevents the second rail 24 from being displaced from the predetermined position Y in the retracting direction D2.

When the second rail 24 is at the predetermined position Y with respect to the first rail 22, the front end f2 of the second rail 24 preferably extends a certain distance beyond the front end f1 of the first rail 22 so that, when it is desired to remount the third rail 26 after the third rail 26 is detached from the second channel of the second rail 24 in the opening direction D1, the user can easily align the rear end r3 of the third rail 26 with the corresponding channel opening of the second channel of the second rail 24 in order to insert the third rail 26 back into the second channel of the second rail 24. It is worth mentioning that the technical principle of detaching the third rail 26 from the second channel of the second rail 24 is comprehensible to a person of ordinary skill in the art and, for the sake of brevity therefore, will not be detailed herein.

Figure 16:
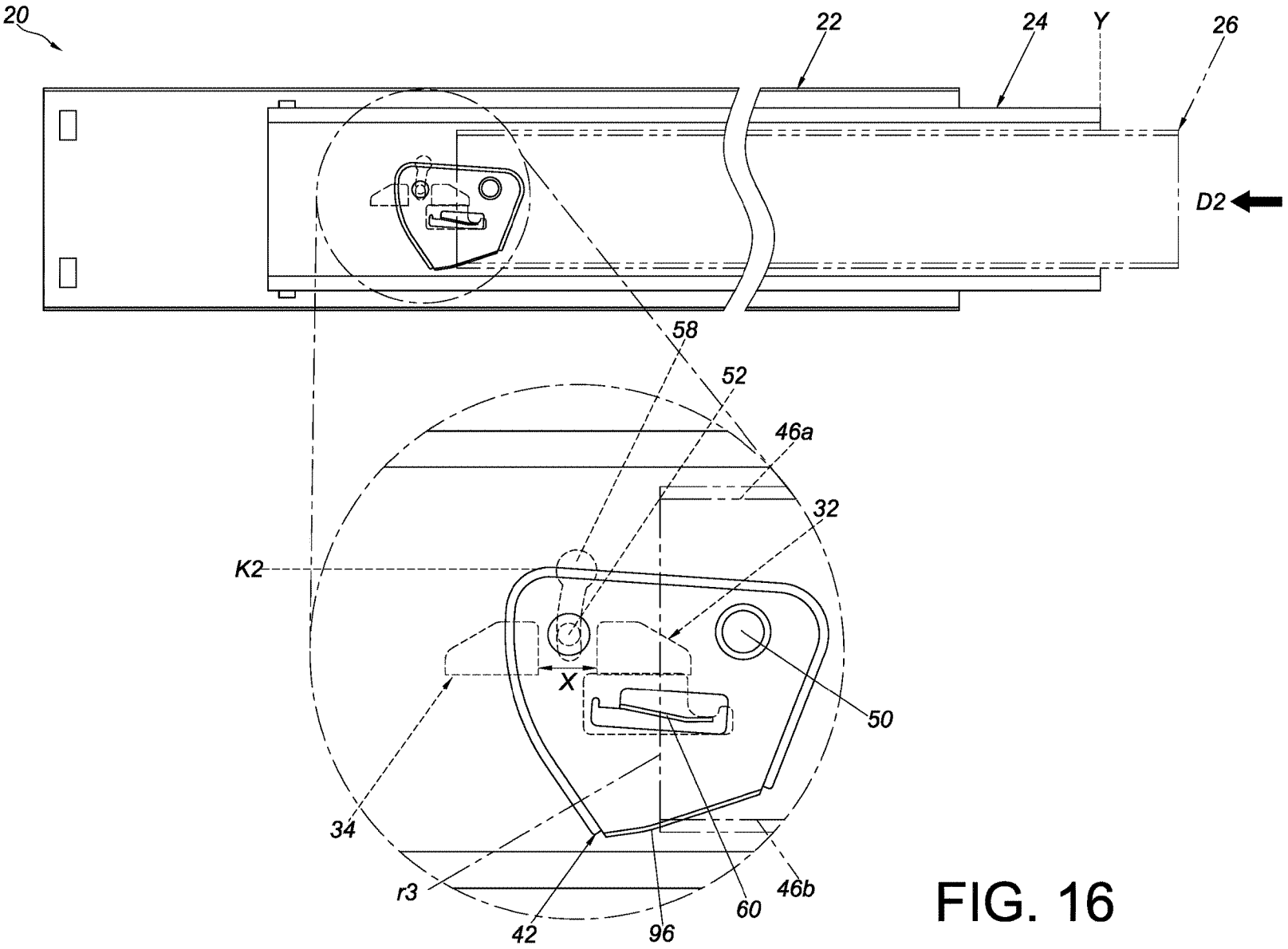
FIG. 16 is a schematic drawing showing that the second rail of the slide rail assembly according to the embodiment of the present invention is at the predetermined position, and that the third rail is displaced from an opened position in the retracting direction.
Figure 17:
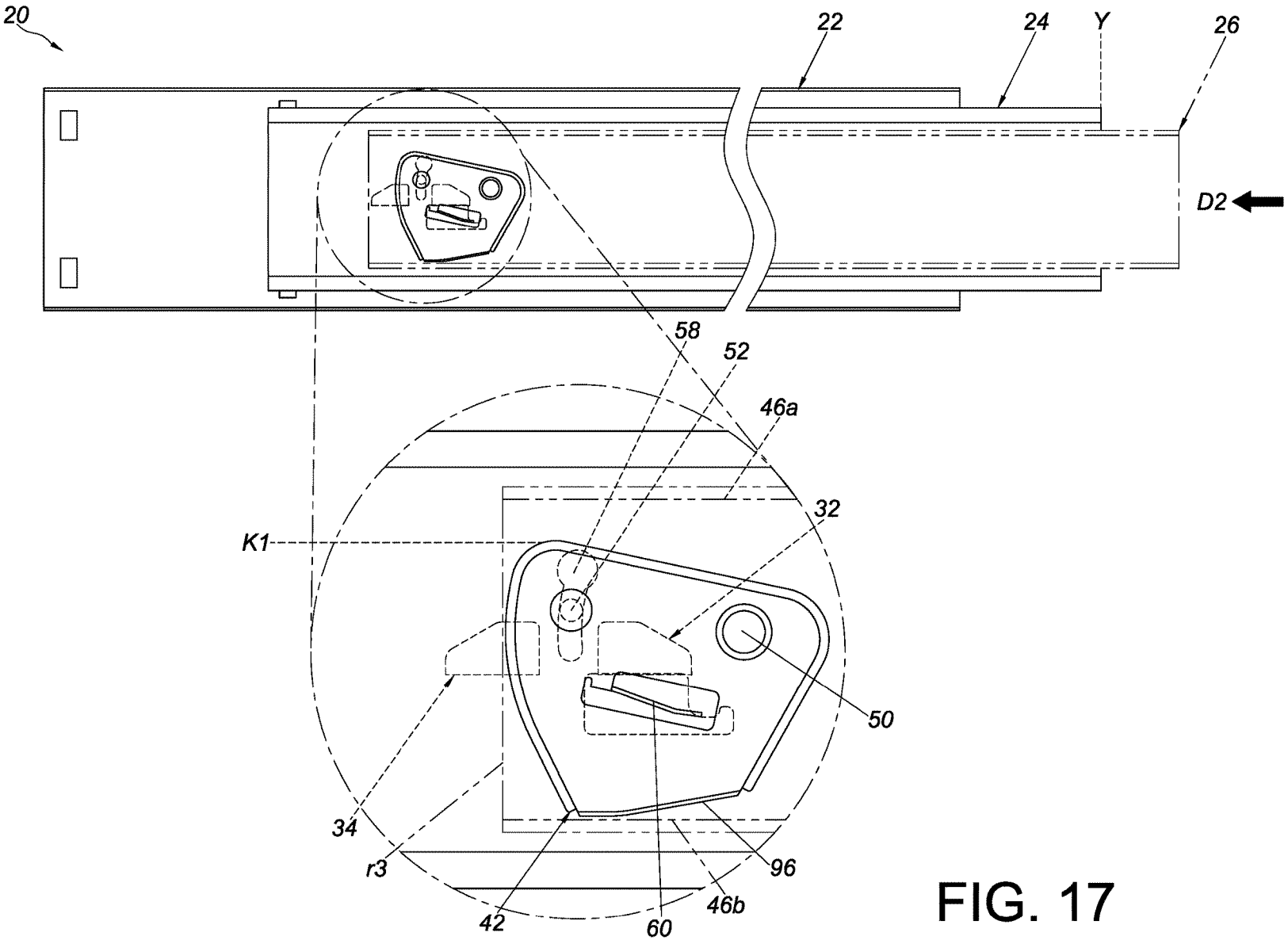
FIG. 17 is a schematic drawing showing that the second rail of the slide rail assembly according to the embodiment of the present invention is at the predetermined position, and that the third rail is further displaced in the retracting direction.

Referring to FIG. 16 and FIG. 17, the working member 42 includes a guiding feature 96. The guiding feature 96 is, for example but not limited to, an inclined surface or a curved surface. When the second rail 24 is at the predetermined position Y with respect to the first rail 22, displacing the third rail 26 in the retracting direction D2 will cause the working member 42 to be driven by a portion, such as the rear end r3, of the third rail 26 and thus brought from the second working state K2 (see FIG. 16) back to the first working state K1 (see FIG. 17). The working member 42 can once again supported by the second wall 46*b* of the third rail 26 and kept in the first working state K1, with the elastic structure 60 accumulating an elastic force, and the working portion 52 of the working member 42 outside the receiving space X between the first stop 32 and the second stop 34. The second rail 24, therefore, can be displaced from the predetermined position Y in either of the retracting direction D2 and the opening direction D1. For example, the second rail 24 and the third rail 26 can now be displaced in the retracting direction D2 to bring the slide rail assembly 20 back into the retracted state (see FIG. 6).

Figure 18:
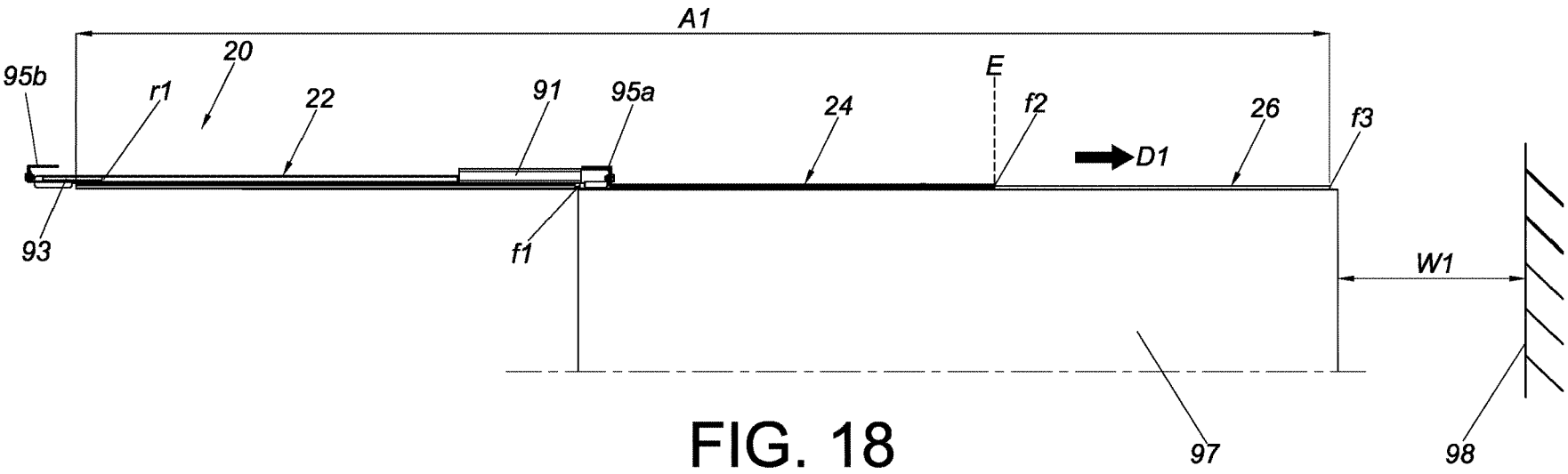
FIG. 18 shows that the slide rail assembly according to the embodiment of the present invention is applied to a rack system, with the second rail at the extended position with respect to the first rail, and the slide rail assembly having a first length.
Figure 19:
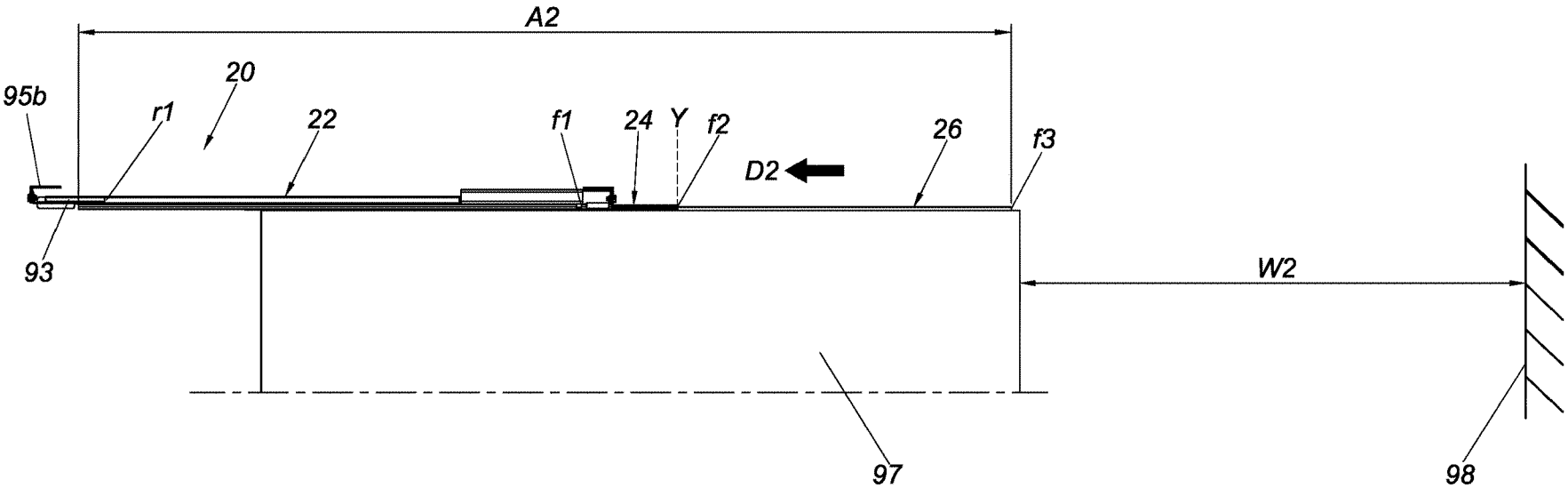
FIG. 19 shows that the slide rail assembly according to the embodiment of the present invention is applied to a rack system, with the second rail at the predetermined position with respect to the first rail, and the slide rail assembly having a second length.

The slide rail assembly 20 of the foregoing configuration can be used in a narrow space as shown in FIG. 18 and FIG. 19, in which the slide rail assembly 20 is mounted on a rack and used in a particular environment. The front end f1 and the rear end r1 of the first rail 22 are mounted on a first post 95*a* and a second post 95*b* of the rack via a first bracket 91 and a second bracket 93 respectively. The third rail 26 serves to carry an object 97.

More specifically, when the second rail 24 is at the extended position E with respect to the first rail 22 and the third rail 26 reaches an opened position after being displaced with respect to the second rail 24 in the opening direction D1, the slide rail assembly 20 has a first length A1. Wherein, there is a first space W1 between the front end f3 of the third rail 26 (or of the object 97) and an obstacle 98 (e.g., a wall, a door, or other obstacles in the environment). If the first space W1 is too narrow for a user to perform on-site maintenance work on the object 97 or the slide rail assembly 20, the user may operate the operating member 80 to free the engaging member 44 from blockage by the blocking structure 36 (see FIG. 11 and FIG. 12 and their description) so that the second rail 24 can be displaced with respect to the first rail 22 from the extended position E to the predetermined position Y in the retracting direction D2 (see FIG. 19), creating a second space W2 between the front end f3 of the third rail 26 and the obstacle 98, wherein the second space W2 is wider than the first space W1 to facilitate detachment of the object 97 or on-site maintenance of the slide rail assembly 20. When the second rail 24 is at the predetermined position Y with respect to the first rail 22, the slide rail assembly 20 has a second length A2 shorter than the first length A1.

It can be known from the above that the slide rail assembly 20 according to the foregoing embodiment of the present invention preferably has the following features:

1. When at the predetermined position Y with respect to the first rail 22, the second rail 24 is either blocked by the first stop 32 via the working member 42 and thus prevented from being displaced from the predetermined position Y in the opening direction D1, or blocked by the second stop 34 via the working member 42 and thus prevented from being displaced from the predetermined position Y in the retracting direction D2.
2. When at the extended position E with respect to the first rail 22, the second rail 24 is blocked by the blocking structure 36 of the first rail 22 via the engaging member 44 and is thus prevented from being displaced from the extended position E in the retracting direction D2.
3. The slide rail assembly 20 has the first length A1 when the second rail 24 is at the extended position E and has the second length A2 when the second rail 24 is at the predetermined position Y, wherein the second length A2 is shorter than the first length A1.
4. The working portion 52 of the working member 42 has a columnar configuration and hence relatively high structural strength. When the working member 42 is blocked between the first stop 32 and the second stop 34 via the working portion 52, the working portion 52 helps position the second rail 24 reliably at the predetermined position Y.
5. The shaft 50 pivotally connects the working member 42 to the longitudinal wall 40 of the second rail 24 in the transverse direction h1, whereas the pivotal connection member 68 pivotally connects the engaging member 44 to the longitudinal wall 40 of the second rail 24 in the height direction h2. The height direction h2 is substantially perpendicular to the transverse direction h1.

While the present invention has been disclosed through the preferred embodiment described above, the embodiment is not intended to be restrictive of the scope of the invention. The scope of patent protection sought by the applicant is defined by the appended claims.

What is claimed is:

1. A slide rail assembly, comprising:
a first rail;
a second rail longitudinally displaceable with respect to the first rail;
a first stop disposed on the first rail;
a blocking structure disposed on the first rail, the blocking structure including a guiding section and a blocking section;
an engaging member movably mounted on the second rail;
a working member movably mounted on the second rail;
a working portion coupled to the working member, the working portion having a columnar configuration; and
a third rail longitudinally displaceable with respect to the second rail;
wherein the second rail, responsive to reaching an extended position after displacement with respect to the first rail in an opening direction and the engaging member being cammingly displaced by the guiding section is blocked by the blocking section via the engaging member, the second rail being thereby prevented from displacing from the extended position in a retracting direction opposite to the opening direction, the third rail being configured to be extended beyond the extended position and retracted from the extended position;
wherein the second rail, when reaching a predetermined position after displacement with respect to the first rail from the extended position in the retracting direction following termination of a blocking relationship between the engaging member and the blocking section, is blocked by the first stop via the working portion, the working member not being in contact directly with the first stop, the second rail being thereby prevented from displacing from the predetermined position in the opening direction;
wherein the slide rail assembly has a first length when the second rail is at the extended position; and
wherein the slide rail assembly has a second length shorter than the first length when the second rail is at the predetermined position.

2. The slide rail assembly of claim 1, wherein the second rail includes a first wall, a second wall, and a longitudinal wall connected between the first wall and the second wall of the second rail, and the slide rail assembly further comprises a shaft for pivotally connecting the working member to the longitudinal wall of the second rail in a transverse direction.

3. The slide rail assembly of claim 1, wherein the longitudinal wall of the second rail has a first position-limiting wall section, a second position-limiting wall section, and an extension hole defined between the first position-limiting wall section and the second position-limiting wall section, and the extension hole is configured to allow passage of the working portion therethrough.

4. The slide rail assembly of claim 1, further comprising an elastic structure for applying an elastic force to bias the working member to be blocked by the first stop.

5. The slide rail assembly of claim 1, further comprising a second stop disposed on the first rail such that when the second rail is at the predetermined position with respect to the first rail, the working member is blocked by the second stop via the working portion and thereby prevents the second rail from displacing from the predetermined position in the retracting direction.

6. The slide rail assembly of claim 1, wherein the second rail is movably mounted between the first rail and the third rail.

7. The slide rail assembly of claim 1, further comprising a pivotal connection member for pivotally connecting the engaging member to the longitudinal wall of the second rail in a height direction, wherein the height direction is substantially perpendicular to the transverse direction.

8. The slide rail assembly of claim 7, further comprising an elastic feature for applying an elastic force to bias the engaging member to be blocked by the blocking structure.

9. The slide rail assembly of claim 1, further comprising an operating member disposed on one of the first rail and the second rail, wherein the operating member is configured to be operated in order to drive the engaging member and thereby free the engaging member from blockage by the blocking structure.

10. A slide rail assembly, comprising:

a first rail;

a second rail displaceable with respect to the first rail;

a third rail displaceable with respect to the second rail;

a first stop disposed on the first rail;

a blocking structure disposed on the first rail, the blocking structure including a guiding section and a blocking section;

an engaging member movably mounted on the second rail; and a working member movably mounted on the second rail;

a working portion coupled to the working member, the working portion having a columnar configuration; and a third rail longitudinally displaceable with respect to the second rail;

wherein the second rail, responsive to reaching an extended position after displacement with respect to the first rail in an opening direction and the engaging member being cammingly displaced by the guiding section, is blocked by the blocking section via the engaging member, the second rail being thereby prevented from displacing from the extended position in a retracting direction opposite to the opening direction, the third rail being configured to be extended beyond the extended position and retracted from the extended position;

wherein the second rail, when reaching a predetermined position after displacement with respect to the first rail from the extended position in the retracting direction following termination of a blocking relationship between the engaging member and the blocking section, is blocked by the first stop via the working portion, the working member not being in contact directly with the first stop, the second rail being thereby prevented from displacing from the predetermined position in the opening direction.

11. The slide rail assembly of claim 10, wherein the second rail includes a first wall, a second wall, and a longitudinal wall connected between the first wall and the second wall of the second rail, and the slide rail assembly further comprises a shaft for pivotally connecting the working member to the longitudinal wall of the second rail.

12. The slide rail assembly of claim 10, wherein the longitudinal wall of the second rail has a first position-limiting wall section, a second position-limiting wall section, and an extension hole defined between the first position-limiting wall section and the second position-limiting wall section, and the extension hole is configured to allow passage of the working portion therethrough.

13. The slide rail assembly of claim 10, further comprising an elastic structure for applying an elastic force to bias the working member to be blocked by the first stop.

14. The slide rail assembly of claim 10, further comprising a second stop disposed on the first rail such that when the second rail is at the predetermined position with respect to the first rail, the working member is blocked by the second stop via the working portion and thereby prevents the second rail from displacing from the predetermined position in the retracting direction.

15. The slide rail assembly of claim 11, further comprising a pivotal connection member for pivotally connecting the engaging member to the longitudinal wall of the second rail.

16. The slide rail assembly of claim 15, further comprising:

an elastic feature for applying an elastic force to bias the engaging member to be blocked by the blocking structure; and an operating member disposed on one of the first rail and the second rail, wherein the operating member is configured to be operated in order to drive the engaging member and thereby free the engaging member from blockage by the blocking structure.

* * * * *